United States Patent [19]

Lathrop, II

[11] 3,962,568

[45] June 8, 1976

[54] RANGE EXTENDING ATTACHMENT FOR USE IN A PRICE DISPLAY MECHANISM

[76] Inventor: Francis M. Lathrop, II, 10306 Neuens, Houston, Tex. 77043

[22] Filed: Apr. 10, 1975

[21] Appl. No.: 566,927

[52] U.S. Cl. ..... 235/132 R; 235/1 A; 235/1 C; 235/24; 235/61 M; 235/94 A

[51] Int. Cl.[2] ..... B67D 5/22; G07G 1/02

[58] Field of Search ..... 235/1 A, 24, 61 M, 94 R, 235/94 A, 132 R, 132 A, 1 C

[56] References Cited

UNITED STATES PATENTS

| | | | |
|---|---|---|---|
| 1,672,533 | 6/1928 | Jurs | 235/1 A UX |
| 2,079,295 | 5/1937 | Logan et al. | 235/1 A UX |
| 2,463,594 | 3/1949 | Brigham | 235/1 A X |
| 3,469,775 | 9/1969 | Kelch et al. | 235/1 A |
| 3,501,092 | 3/1970 | Mueller | 235/1 A |
| 3,618,852 | 11/1971 | Kes et al. | 235/94 R |
| 3,635,395 | 1/1972 | Walsh | 235/1 A |

*Primary Examiner*—L. T. Hix
*Assistant Examiner*—Stanley J. Witkowski

[57] ABSTRACT

This disclosure is directed to an attachment for a limited range gasoline pump. Many gasoline pumps are limited in price range to $9.99. The apparatus comprises an attachment wherein the number one is located on the face of the pump to extend its range to $19.99, and a flag bearing a dollar sign is placed over the number one. The flag remains in position if the sale is $9.99 or less. If that value is exceeded, the flag is moved to the left to expose the one, keeping the dollar sign correctly located. Movement is controlled by a cam attached to the rotating number wheel which displays the dollar value. This wheel is mounted on a cross shaft. The attachment cooperates with the cross shaft to respond to movement thereof to provide a reset motion when the gasoline pump is reset to zero. The apparatus thus includes a reset mechanism which follows the cross shaft when it moves, a cam follower which moves to the left when viewing the face to display the one, and a mask which is mounted on a rack and pinion which is spring loaded against movement and unwanted vibration.

10 Claims, 8 Drawing Figures

FIG. 1
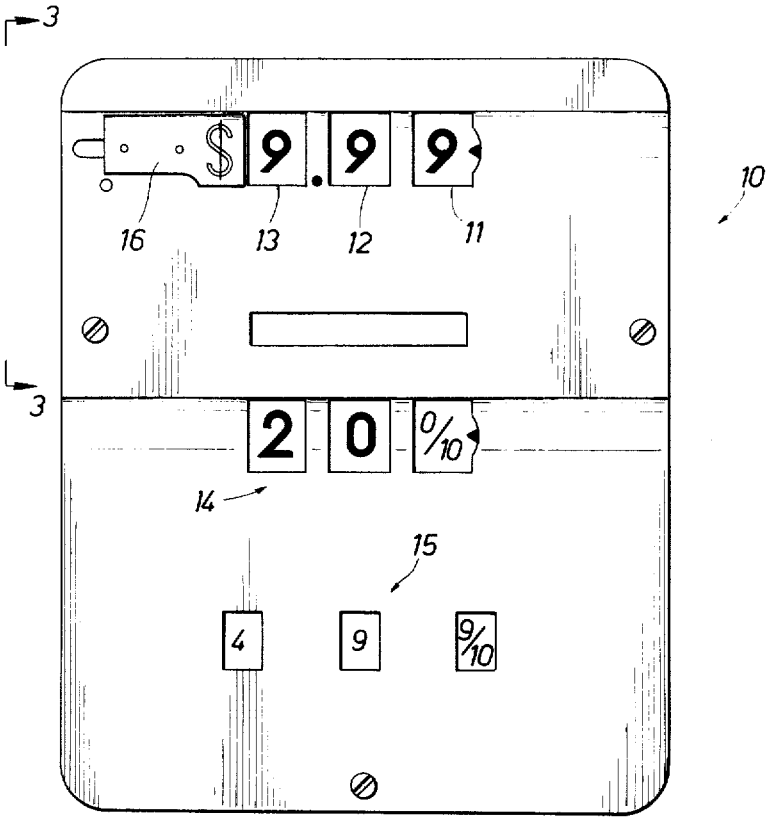
FIG. 2
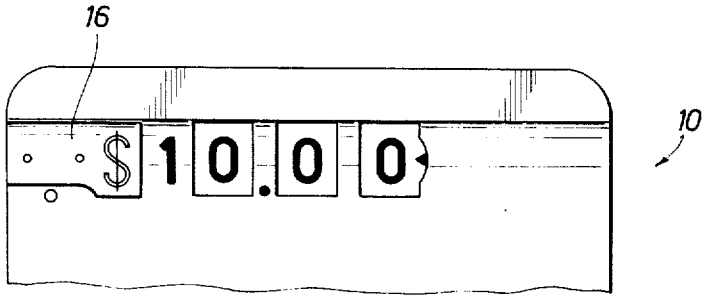
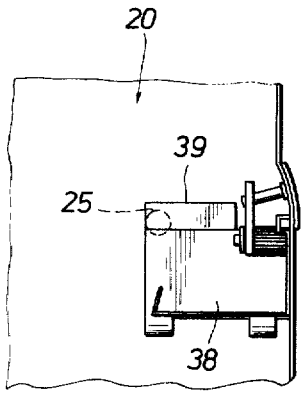
FIG. 3

FIG. 4
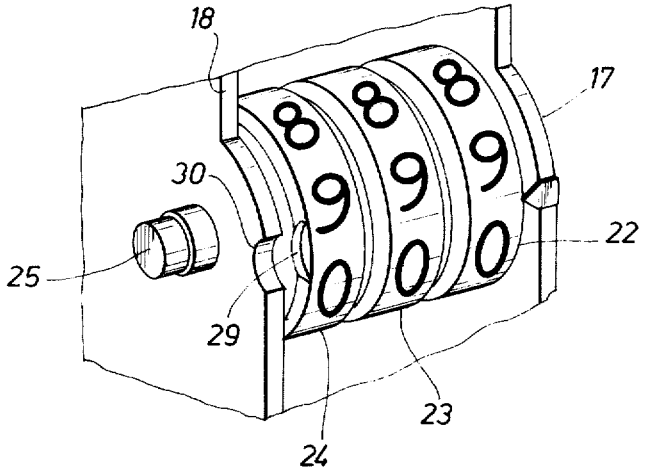
FIG. 5
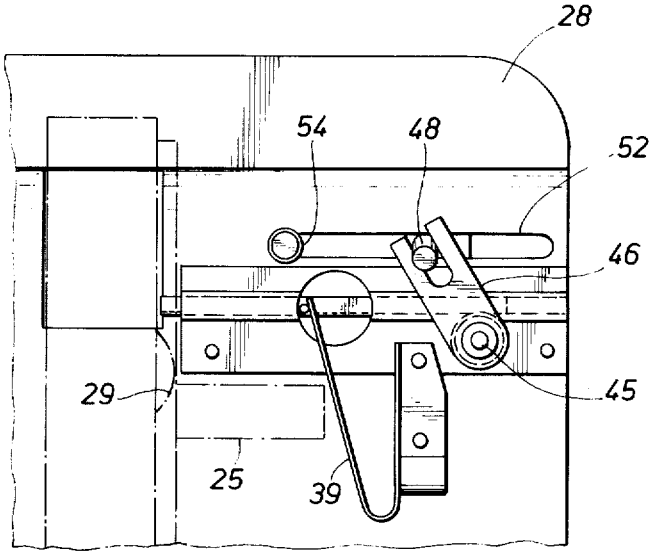
FIG. 7
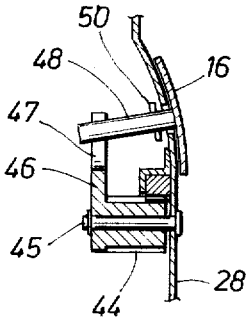
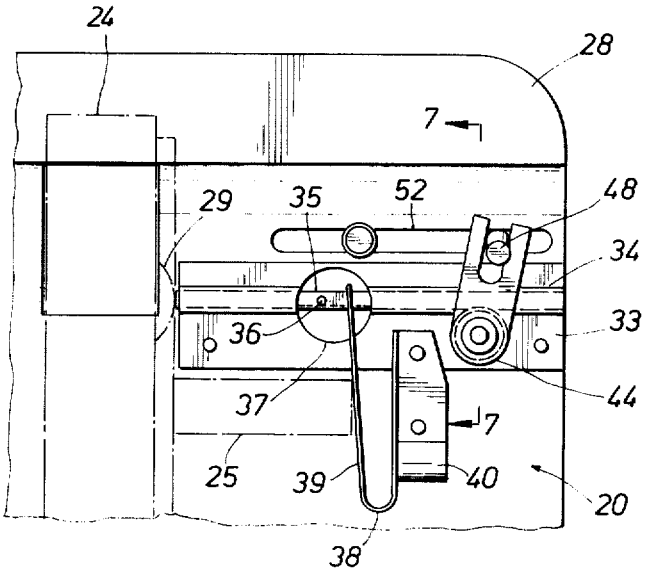
FIG. 6

RANGE EXTENDING ATTACHMENT FOR USE IN A PRICE DISPLAY MECHANISM

BACKGROUND OF THE INVENTION

With the recent increase in gasoline pricing, a sale of many gallons will approach $10.00 or more. Preexistant gasoline pumps permit only three decades of price calculations. The effective ceiling is $9.99 per sale. It is somewhat difficult to explain to a customer that the purchase price is over $10.00 if the exact sum is not shown on the pump. As a consequence, sales from $10.00 to $15.00 are often misunderstood. The present invention enables modification of a gasoline pump to extend the indicated measure from $9.99 to $19.99.

The present invention thus enables a gasoline pump to extend its dollar capacity to $19.99 without requiring expensive replacement of the computing head of the pump, the dial face, and associated problems. The present invention can be readily installed without requiring recalibration of the equipment by weight and measure authorities who must verify that the device is correctly registering the dollar value of the product sold.

SUMMARY OF THE INVENTION

The present invention is an attachment for a preexisting gasoline pump. The pre-existing pump includes three wheels which provides pricing for cents, tens, and dollars. The wheels are identical, and each includes a full decade of numbers. To enable the device to proceed past $9.99, the present invention contemplates placing a one decal on the face of the gasoline pump. The decal is covered by a flag with has a dollar sign thereon. The dollar sign is always visible. In the event the sale exceeds $9.99, the flag with the dollar sign thereon is pulled to the left to expose the decal. The three wheels are mounted on a cross shaft which moves lengthwise on resetting to zero. The attachment contemplates placing a cam on the dollar wheel which has a particular relationship to the nine dollar mark. The cam is located to trigger the equipment into operation upon exceeding $9.99. The cam works against a cam follower which is connected to a rack and pinion. The rack connects to a slide mechanism which extends through the face of the equipment to move the flag to expose the digit on the decal. The rack and pinion cooperates with an arm connected to the slide. The arm is pressed against a spring to prevent movement as a result of vibration. The cross shaft works against a cam or reset follower. The reset follower restores the slide and rack to the closed position upon resetting.

DESCRIPTION OF THE DRAWINGS

FIG. 1 is a front view of the price indicator of a gas pump incorporating the present invention which shows a dollar sign on a slide mechanism;

FIG. 2 is a view similar to FIG. 1 showing the slide mechanism after movement to the left, exposing an additional number to extend the dollar range from $9.99 to $19.99;

FIG. 3 is a view along the line 3 — 3 of FIG. 1 showing the attachment of the present invention on the back side of the face of the pump;

FIG. 4 shows modifications made to the framework of the price computer and a cam attached to the dollar wheel thereof;

FIG. 5 is a view from the back side of the face showing the present invention installed adjacent to the dollar wheel and during reset movement to the left;

FIG. 6 is a view similar to FIG. 5 showing the apparatus after movement wherein the slide mechanism has been moved to expose the one and thereby increase the range of the gas pump;

FIG. 7 is a sectional view along the line 7 — 7 of FIG. 6 showing details of construction of the apparatus relative to the face plate or panel; and, FIG. 8 is an isometric view of a second embodiment of the price modification equipment of the present invention.

DESCRIPTION OF THE PREFERRED EMBODIMENTS

Figure 8:
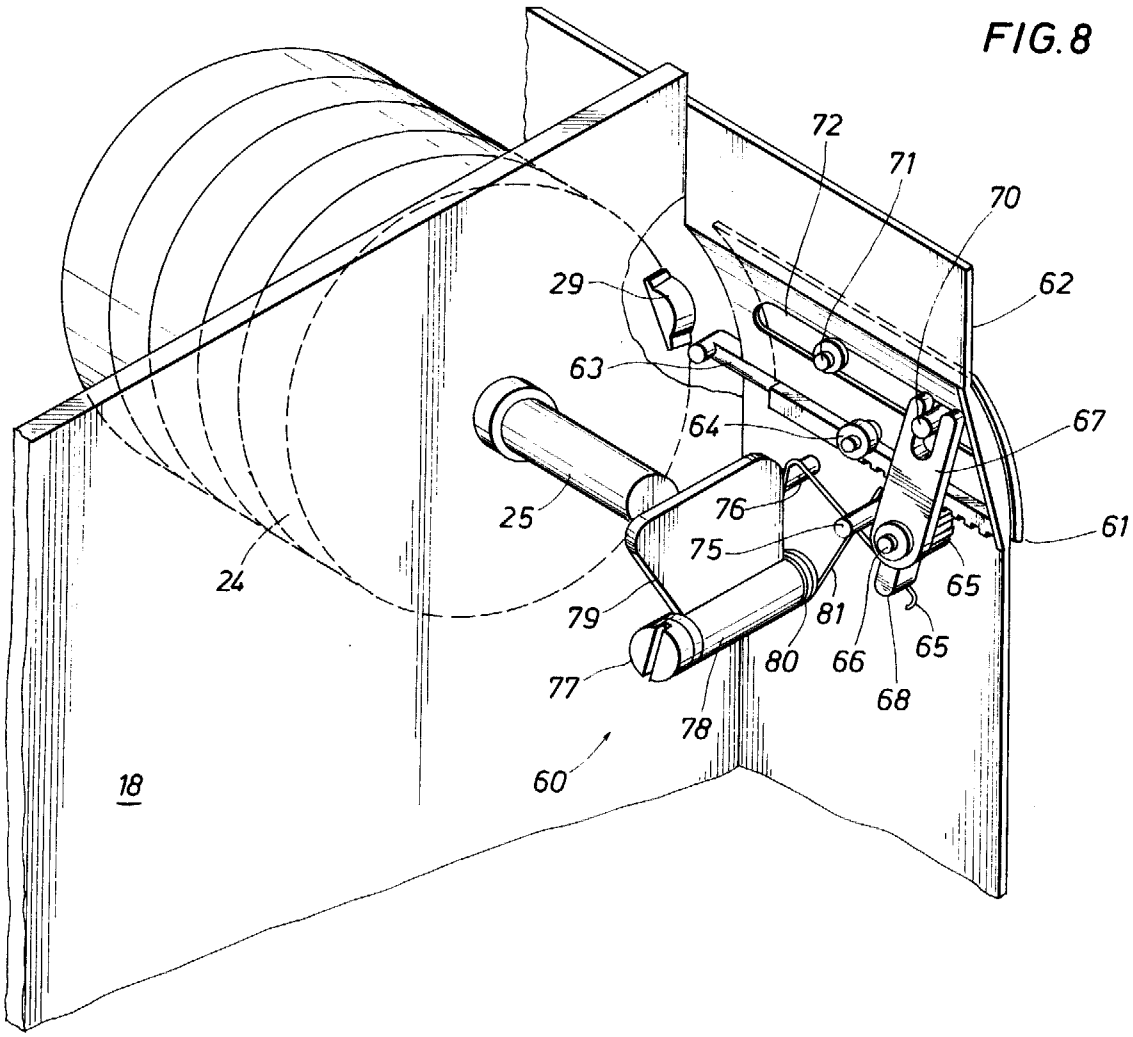

Attention is first directed to FIG. 1 where the face 10 of a gas pump is shown. It displays in windows 11, 12 and 13 decimal numbers which indicate cents, tens, and dollars. Another set of cut outs at 14 display the total gallons delivered, and the price per gallon is indicated at 15. The gas pump is unmodified insofar as these features are concerned.

The modification of the present invention contemplates placing a slide 16 on the face. The slide 16 carries on it a dollar sign which is visible at all times. It is in the unactuated position in FIG. 1. The slide 16 has been actuated in FIG. 2. It moves to the left to display the number one to thereby enable the apparatus to display prices of $19.99, $10.00 more than that permitted without the present invention. This can be achieved without requiring substantial reconstruction, overhaul, calibration or certification of the equipment.

In FIG. 4, one side wall 17 and a parallel wall 18 enclose the price calculator. The modification 20 shown in FIG. 3 is adapted to be installed adjacent to the wall 18 of FIG. 4. The walls 17 and 18 support a penny wheel 22, a dime wheel 23, and a dollar wheel 24. The wheels have a specified face, width and have decimal numbers thereon. The decimal numbers are visible through the windows 11, 12 and 13 to display the digits comprising the sale price.

The three digit wheels 22, 23 and 24 are all similar in construction and diameter, are all similarly equipped with a clutch, and all reset in the same manner by rotating in a direction to display smaller numbers until zero is reached. They reset by advancing toward smaller numbers and return to zero. The displayed numbers are shown in FIGS. 1 and 2. The wheels are all supported on a cross shaft 25. The cross shaft extends outwardly during normal operation to a specified distance. It is retracted during the reset cycle. The retraction may be instantaneous, or indefinite. Its duration is not material, but its occurrance between sales is normally required by law. In any event, upon retraction, the present invention 20 takes advantage of the retraction movement to reset the present invention simultaneously with resetting of the price wheels 22, 23 and 24. The description of the price wheels and the equipment cooperative therewith is more fully described in the literature of Veeder Root Co.

Attention is directed to FIG. 5. The front face 28 of the equipment is formed of sheet metal. The cross shaft 25 is shown in dotted line. A cam 29 is affixed to the dollar wheel 24 as shown in FIG. 4. It is located past the nine just short of the zero. It comes into play only if the dollar wheel advances past the nine to the next digit or zero. The cam protrudes outwardly to the side from the dollar wheel. The cam 29 is detected by apparatus to be described which reaches past the wall 18 through a notch 30 cut in the wall as shown in FIG. 4. More will be noted concerning this hereinafter.

In FIG. 6, the cross shaft 25 is shown in dotted line at the customary length normally maintained by it. During reset, it moves to the left as shown in FIG. 5. The cross shaft 25 provides the timed movement converted by the attachment 20 into reset of the present invention wherein the number one shown in FIG. 2 is covered by the slide 16.

The attachment 20 includes a plate 33 which is bolted or riveted to the back of the face plate 28. The plate 33 serves as a mounting plate. It is folded along its length to define an internal channel 34. The channel 34 captures and receives a slidably mounted rack 35. The rack 35 is freely movable in the channel 34. The channel 34 captures the rack 35 on three sides while the face plate 28 captures it on the fourth side. The back plate 33 is fastened against the face plate 28 to provide accommodation for the rack 35.

The rack 35 extends to the left in near proximity of the dollar wheel 24. It extends through the notch 30 cut in the wall 18 as shown in FIG. 4. It extends into the path of the cam 29. In FIG. 5, it is extended to the left-most extreme of movement. In FIG. 6, it is shown after it has been moved to the right by the cam 29. The rack 35 carries a pin 36 located in the central portions thereof and protruding outwardly therefrom through an opening 37 formed in the back plate 33. This exposes the pin for movement.

The pin 36 is moved to the left by means of a U-shaped spring 38 which has a cantilevered arm 39 extending in the vicinity of the pin. The arm 39 is fairly wide as shown in FIG. 3. The arm 39 contacts the pin 36 and is also sufficiently wide to intercept the cross shaft 25. The spring 38 is formed of sheet stock and is shaped into a U-shaped member where the two major are not quite symmetrical in shape. The fixed arm of the spring 38 connects to a flange plate 40 shown in FIG. 6 attached to the front plate 28 and the back plate 33. It is anchored in a generally vertical posture. The arm 39 is free to flex and bend. It bears to the left against the cross shaft 25. When the cross shaft 25 moves to the left, as shown by its dotted line position in FIG. 5, the arm 39 follows it and by that movement, pushes the pin 35 to the left, returning the rack 35 to its left-most position. The rack 35 stays in this position when the cross shaft 25 pushes to the right again after completion of the reset step which occurs in the movement of the cross shaft 25. The spring arm 39 serves as a reset mechanism as will be described. It is timed in reset to coincide with resetting of the price computer in the gasoline pump.

The rack 35 has gear teeth on its lower edge and meshes with a gear 44. The gear 44 is mounted on a shaft 45 in FIG. 7. The shaft 45 also supports an arm 46 which is bifurcated at the upper end. The arm 46 swings with rotation of the gear 44. The arm 46 extends upwardly to capture a pin 48 in the slot 47 shown in FIG. 7. The slot 47 has adequate length to enable the pin to move along the slot as the radial length of the arm 46 varies during rotation. As shown in FIG. 7, customarily the face plate 28 is curved and the plate 16 which forms a mask is curved to the same contour. The pin 48 angles downwardly slightly. The mask 16 is made fast to the plate 28 by means of a lock ring 50 on the shaft or pin 48. The arm 46 rotates left and right to carry the pin 48 with it and move the mask 16 between the two desired operative positions shown in FIGS. 1 and 2. The pin 48 extends through a slot 52 cut in the face plate 28 better shown in FIGS. 5 and 6. This slot has sufficient horizontal length to guide the pin 48. The mask 16 travels in front of the slot. Alignment of the mask is assured by securing the mask relative to the slot by use of the pin 48 and a second pin 54. The pin 54 extends through the slot 52 and includes an enlargement locking it to the face plate 28. The enlargement on the end 54 prevents the pin 54 from escaping the slot 52. The pin 54 is located to limit the left hand extremity of movement as shown in FIGS. 5 and 6. The left hand extremity of movement is achieved when the dollar sign is properly positioned as shown in FIG. 1. The right hand extremity of movement is determined by the maximum range of travel of the rack 35 when it encounters the cam 29. The rack 35 is free to move to the right as viewed in FIG. 6 and does so without contacting the pin 36 against the arm 39 which is pushed away from the pin by the cross shaft 25. The arm 39 is held sufficiently to the right to enable more than adequate freedom to the rack 35 for movement to the right.

When the dollar amount passes $9.99, the cam 29 is brought to the position opposite the notch 30 shown in FIG. 4. The rack 35 senses its presence and is pushed to the right as viewed in FIG. 6. When it moves to the right, it rotates the gear 44. The slight movement of the rack 35 is multiplied by the arm 46. It rotates through a specified angle. As it rotates, it carries the pin 48 with it. The pin 48 moves further than the rack 35 in response to the multiplication provided by the arm 46. This opens the mask 16 to the position of FIG. 2 of the drawings. This moves all of the apparatus to the right as viewed in FIG. 6. This position is held indefinitely even though the cam 29 may advance on the occasion of sales exceeding $10.00. The cam 29 is not required to hold the position illustrated in FIG. 6, but rather it provides that position and can rotate to any other position. At the conclusion of the sale, the one remains visible indefinitely until reset. When reset occurs, the cross shaft 25 momentarily moves to the left as shown in dotted line in FIG. 5. This enables the arm 39 of the spring to push the rack 35 to the left, returning it to its position where it is able to find the cam 29 on the next sale exceeding $10.00. This movement is accompanied by rotation of the arm 46 which moves the mask 16 to the position of FIG. 1.

It is not possible for vibration to move the mask 16 accidentally. The frictional drag of the rack 35 in the channel 34 prevents this.

Attention is next directed to FIG. 8 which discloses an alternate form of the present invention identified at 60. The supporting structure is substantially the same, and similar numerals are applied to the supporting structure. A mask 61 supported on a face panel 62 functions similar to that shown in FIGS. 1 and 2. The cam 29 actuates a rack 63 which is guided in a slot in the face plate 62. The version shown in FIG. 8 is adapted for incorporation of a substitute face plate 62 so that the equipment may be assembled to the face plate at a factory location. The rack 63 is captured in the slot by means of an enlargement 64 on a pin. It overhangs the rack. The rack 63 engages the gear 65 mounted on a pin 66. The pin 66 also supports an arm 67 which has a downwardly protruding tab 68. The arm 67 engages a pin 70 mounted on the back of the mask 61. The mask 61 is maintained in a horizontal posture by a second pin 71, and both pins extend through a slot 72 in the face plate 62. The pin 71 has an enlargement which locks the pin in the slot 72 and prevents disengagement. The pins 70 and 71 are slidable to the left as shown in FIG. 8.

The apparatus further includes a fixed post 75 and a second fixed post 76. A mounting screw 77 supports a bushing 78 from which a protruding tab 79 extends. The tab 79 is wide to catch the cross shaft 25 at some point on its face. A coil spring 80 is positioned about the mounting screw 77. The coil spring 80 has a first arm 81 which is locked in position with the post 75. The coil spring has a second arm which is in an inverted V-shape which contacts the post 76 and which has a free cantilevered end 82 which contacts the tab 68. The tab 68 frictionally depresses the arm. The arm tends to push upwardly against it at an angle, thereby providing a reset action as will be described.

When the cam 29 moves past the rack 63, the rack 63 is forced to the right as viewed in FIG. 8 and its movement is imparted to the gear 65. Rotation of the gear 65 rotates the arm 67 clockwise, thereby moving the mask 61 to the position of FIG. 2. This position is maintained indefinitely. The tab 68 frictionally engages the spring 82 and is held at that position. At some point in time thereafter, the dollar number is reset to zero. When the device is reset to zero, the cross shaft 25 moves to the left as viewed in FIG. 8. The spring 80 causes the tab 79 to push to the left to follow the cross shaft. When it does, the rotation of the bushing 78 is communicated to the spring arm 82, thereby moving the spring arm 82. The arm 82 deflects so that the arm 67 is rotated counterclockwise, pushing the pin 70 and moving the slide 61 to the left, or the position of FIG. 1. This reset action occurs on movement of the cross shaft 25. Subsequent return of the cross shaft to its original position torques the spring 80 and causes the free arm 82 to bow, but the tab 68 does not follow on bowing of the spring 82. The spring arm 82 can force it in one direction, but cannot force it in the other direction. That rotational movement is achieved by the rack 63 which is engaged with the gear 65.

The two embodiments are installed similarly. The cam 29 is attached to the dollar wheel and the notch 30 is cut in the adjacent wall. The attachment 20 is installed by means of rivets or bolts attaching it to the face plate. The embodiment 60 is installed by substituting the face plate provided integrally with the apparatus. In either case, installation is quickly achieved and ordinarily does not require recalibration of any portion of the equipment.

The foregoing is directed to the preferred embodiment of the present invention. The scope is determined by the claims which follow.

I claim:

1. For use with a gasoline pump having a price totalizer which a specified number of decimal number wheels, the most significant number wheel having numbers thereon from zero to nine, and a reset mechanism which resets the price totalizer after totaling and before the next sale from the gasoline pump, a range extending apparatus which comprises:

a number serving as the next significant digit and located to indicate its position beyond the most significant number wheel;

mask means for selectively covering and exposing said number;

means for detecting movement of the most significant number wheel past the largest number displayed thereon, said means further moving said mask means to expose said number; and, reset means for restoring said mask means to a position covering said number on operation of the reset mechanism of the totalizer.

2. The apparatus of claim 1 wherein said number is one, and said mask means includes a movable mask which selectively covers and uncovers said number.

3. The apparatus of claim 1 wherein said means for detecting includes a cam means responsive to movement of the most significant number wheel of the totalizer on advancement of that wheel past nine and back to zero thereof, and a means operated by said cam means to move said mask means.

4. The apparatus of claim 3 wherein said last named means includes a slidably positioned bar which communicates movement to said mask means.

5. The apparatus of claim 4 wherein said bar has a rack means therein, and including a gear means rotated thereby, said gear means rotating, and a connective lever connected from said gear means to said mask means.

6. The apparatus of claim 5 wherein said lever rotates with said gear and said lever is connected to said mask means to move it between the covered and exposed positions.

7. The apparatus of claim 6 wherein said mask means is slidably movable along a specified path, and said lever is engaged by a follower means connected to said mask means.

8. The apparatus of claim 7 including a resilient means biasing said mask means against movement which bias is overcome by movement of bar imparted by said lever, but not by vibration of the gasoline pump.

9. The apparatus of claim 7 wherein said lever is slidably engaged with said follower means at a slot therein.

10. The apparatus of claim 7 wherein said mask means includes a protruding means positioned in a slot of specified length which enables movement between two positions to expose and cover said number.

* * * * *